US009169844B2

(12) United States Patent
Lin et al.

(10) Patent No.: US 9,169,844 B2
(45) Date of Patent: Oct. 27, 2015

(54) CENTRIFUGAL FAN AND IMPELLER THEREOF

(75) Inventors: Hsin-Chen Lin, Taoyuan Hsien (TW); Hsiang-Jung Huang, Taoyuan Hsien (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 548 days.

(21) Appl. No.: 13/237,954

(22) Filed: Sep. 21, 2011

(65) Prior Publication Data

US 2012/0128486 A1 May 24, 2012

(30) Foreign Application Priority Data

Nov. 24, 2010 (TW) ..... 99140494

(51) Int. Cl.

| | |
|---|---|
| ***F04D 29/16*** | (2006.01) |
| ***F04D 25/06*** | (2006.01) |
| ***F04D 17/16*** | (2006.01) |
| ***F04D 29/30*** | (2006.01) |

(52) U.S. Cl.

CPC ..... *F04D 25/0613* (2013.01); *F04D 17/16* (2013.01); *F04D 17/162* (2013.01); *F04D 29/162* (2013.01); *F04D 29/30* (2013.01)

(58) Field of Classification Search

CPC ..... F04D 17/162; F04D 17/16; F04D 29/281; F04D 29/30; F04D 25/082; F04D 25/0613; F04D 29/162

USPC ..... 416/210 R, 223 R, 235, 236 R, 236 A, 416/183–185, 228, 237; 415/204, 206

See application file for complete search history.

(56) References Cited

U.S. PATENT DOCUMENTS

| | | | | |
|---|---|---|---|---|
| 6,568,907 | B2 * | 5/2003 | Horng et al. | 416/185 |
| 6,579,064 | B2 * | 6/2003 | Hsieh | 416/182 |
| 7,044,720 | B1 | 5/2006 | Yamamoto et al. | |
| 7,063,510 | B2 * | 6/2006 | Takeshita et al. | 416/210 R |
| 2005/0002793 | A1 | 1/2005 | Wu et al. | |
| 2006/0222491 | A1 * | 10/2006 | Shimada | 415/206 |
| 2009/0162210 | A1 * | 6/2009 | Hwang et al. | 416/96 R |

FOREIGN PATENT DOCUMENTS

| | | |
|---|---|---|
| TW | I267584 | 12/2006 |

* cited by examiner

*Primary Examiner* — Edward Look
*Assistant Examiner* — Danielle M Christensen
(74) *Attorney, Agent, or Firm* — CKC & Partners Co., Ltd.

(57) ABSTRACT

A centrifugal fan includes an impeller, a motor and a case. The impeller includes a hub and multiple blades. The hub has a center. The blades are connected to the hub and have all respective outmost edges collectively define a circle with the center and a radius R. Each blade has at least one concave cutout. Each concave cutout is equipped with a depth of greater than 0.5 millimeters and an obtuse angle of less than 170 degrees, wherein the obtuse angle is an included angle between an inner edge of the concave cutout and an outer edge of the blade. The motor is secured to the huh and drives the impeller to rotate. The case houses the impeller and the motor.

16 Claims, 6 Drawing Sheets

CENTRIFUGAL FAN AND IMPELLER THEREOF

RELATED APPLICATIONS

This application claims priority to Taiwan Application Serial Number 099140494, filed Nov. 24, 2010, which is herein incorporated by reference.

BACKGROUND

1. Field of Invention

The present invention relates to a fan device. More particularly, the present invention relates to a centrifugal fan.

2. Description of Related Art

The centrifugal fans are different from the axial fans in that the centrifugal fans intakes air along an axial direction of the impeller and outputs air along a radial direction of the impeller. Referring to FIG. 1, which illustrates a top view of a conventional impeller of the centrifugal fan. The impeller 100 of the centrifugal fan includes a hub 101 and a plurality of blades 102. The blades 102 are arranged radially around the hub 101.

In order to increase the centrifugal fan's performance, e.g. increasing output air volume, one of the solutions is to add more blades 102. When the blades are increased up to a certain number, the blades are crowded in their ends connected to the hub 101. Referring to FIG. 1, when 23 pieces of blades 102 are connected to the hub 101, the blades 102 are crowded in the area around the hub 101. Due to a high density around the hub 101, less air is intake and less air is thus output from the centrifugal fan.

Referring to FIG. 2, which illustrates a cross-sectional view of a conventional fan. One of the solutions is to reduce an axial height of each blade in which dense blades are located, e.g. the upper inclined edge 102*a* and lower inclined edge 102*b* near the hub 101, so as to reduce an intake resistance of the dense blades along the axial direction (as shown in the direction of arrows) and increase air expelled along the axial direction of the blade 102.

However, when the axial height on the blades 102 are reduced, the blades 102 are also reduced in their working areas such that the centrifugal fan's performance can be impacted. Therefore, how to reduce the intake resistance of the dense blades and in increase the working areas of the dense blades so as to improve the centrifugal fan's performance even better is a need in designing the centrifugal fan.

SUMMARY

It is therefore an objective of the present invention to provide an improved centrifugal fan so as to deal with the problems as discussed in the prior art.

In accordance with the foregoing and other objectives of the present invention, an impeller of a centrifugal fan includes a hub and a plurality of blades. The hub has a center. The blades are connected to the hub and have all respective outmost edges collectively to define a circle with the center and a radius R. Each blade has at least one concave cutout. Each concave cutout is equipped with a depth of greater than 0.5 millimeters and an obtuse angle of less than 170 degrees, wherein the obtuse angle is an included angle between an inner edge of the concave cutout and an outer edge of the blade.

According to an embodiment disclosed herein, the concave cutout of each blade is disposed within a region between the center and 0.6R from the center.

According to another embodiment disclosed herein, a number of the concave cutout is at least two, the two concave cutouts of each blade are disposed within a region between the center and 0.6R from the center, and the two concave cutouts are disposed at two opposite outer edges of each blade.

According to another embodiment disclosed herein, the concave cutout is disposed within a region between 0.6R and 0.9R from the center.

According to another embodiment disclosed herein, a number of the concave cutout is at least two, the two concave cutouts of each blade are disposed within a region between 0.6R and 0.9R from the center, and the two concave cutouts are disposed at two opposite outer edges of each blade.

In accordance with the foregoing and other objectives of the present invention, an impeller of a centrifugal fan includes a hub, a connection ring and a plurality of blades. The hub has a center. The connection ring is disposed around the hub. The blades are connected to the connection ring, and have all respective outmost edges collectively to define a circle with the center and a radius R, and at least one first concave cutout is formed between each blade and the hub. The first concave cutout is equipped with a depth of greater than 0.5 millimeters and an obtuse angle of less than 170 degrees, wherein the obtuse angle is an included angle between an inner edge of the concave cutout and an outer edge of the blade.

According to an embodiment disclosed herein, an inner edge of the connection ring is seamlessly connected with an outer edge of the hub.

According to another embodiment disclosed herein, the first concave cutout is disposed within a region between the center and 0.6R from the center.

According to another embodiment disclosed herein, a number of the first concave cutout is at least two, and the two first concave cutouts are disposed at two opposite outer edges of the blade.

According to another embodiment disclosed herein, each blade further comprises at least one second concave cutout, which is disposed within a region between 0.6R and 0.9R from the center.

According to another embodiment disclosed herein, a number of the second concave cutout is at least two, the two second concave cutouts are disposed at two opposite outer edges of the blade.

According to another embodiment disclosed herein, an inner edge of the connection ring is connected with an outer edge of the hub with gaps therebetween.

According to another embodiment disclosed herein, the first concave cutout is disposed within a region between the center and 0.6R from the center.

According to another embodiment disclosed herein, each blade further comprises at least one second concave cutout, which is disposed within a region between 0.6R and 0.9R from the center.

According to another embodiment disclosed herein, a number of the second concave cutout is at least two, the two second concave cutouts are disposed at two opposite outer edges of the blade.

In accordance with the foregoing and other objectives of the present invention, a centrifugal fan includes an impeller, a motor and a case. The impeller includes a hub and a plurality of blades. The hub has a center. The blades are connected to the hub and have all respective outmost edges collectively to define a circle with the center and a radius R. Each blade has at least one concave cutout. Each concave cutout is equipped with a depth of greater than 0.5 millimeters and an obtuse angle of less than 170 degrees, wherein the obtuse angle is an included angle between an inner edge of the concave cutout and an outer edge of the blade. The motor is secured to the hub and drives the impeller to rotate. The case houses the impeller and the motor, and has at least one air inlet disposed along an axial direction of the impeller and at least one air outlet disposed along a radial direction of the impeller.

According to an embodiment disclosed herein, the concave cutout of each blade is disposed within a region between the center and 0.6R from the center.

According to another embodiment disclosed herein, the concave cutout is disposed within a region between 0.6R and 0.9R from the center.

In accordance with the foregoing and other objectives of the present invention, a centrifugal fan includes an impeller, a motor and a case. The impeller includes a hub, a connection ring and a plurality of blades. The hub has a center. The connection ring is disposed around the hub. The blades are connected to the connection ring, and have all respective outmost edges collectively to define a circle with the center and a radius R, and at least one first concave cutout is formed between each blade and the hub. The first concave cutout is equipped with a depth of greater than 0.5 millimeters and an obtuse angle of less than 170 degrees, wherein the obtuse angle is an included angle between an inner edge of the concave cutout and an outer edge of the blade. The motor is secured to the hub and drives the impeller to rotate. The case houses the impeller and the motor, and has at least one air inlet disposed along an axial direction of the impeller and at least one air outlet disposed along a radial direction of the impeller.

According to an embodiment disclosed herein, an inner edge the connection ring is seamlessly connected with an outer edge of the hub, and the first concave cutout is disposed within a region between the center and 0.6R from the center.

According to another embodiment disclosed herein, an inner edge the connection ring is seamlessly connected with an outer edge of the hub, and each blade further comprises at least one second concave cutout, which is disposed within a region between 0.6R and 0.9R from the center.

According to another embodiment disclosed herein, an inner edge the connection ring is connected with an outer edge of the hub with gaps therebetween, and the first concave cutout is disposed within a region between the center and 0.6R from the center.

According to another embodiment disclosed herein, an inner edge the connection ring is connected with an outer edge of the hub with gaps therebetween, and each blade further comprises at least one second concave cutout, which is disposed within a region between 0.6R and 0.9R from the center.

Therefore, the "concave cutout" design on the impeller and centrifugal fan thereof can further enhance its performance, but does not decrease its working areas too much, which inversely impact the centrifugal fan's performance.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
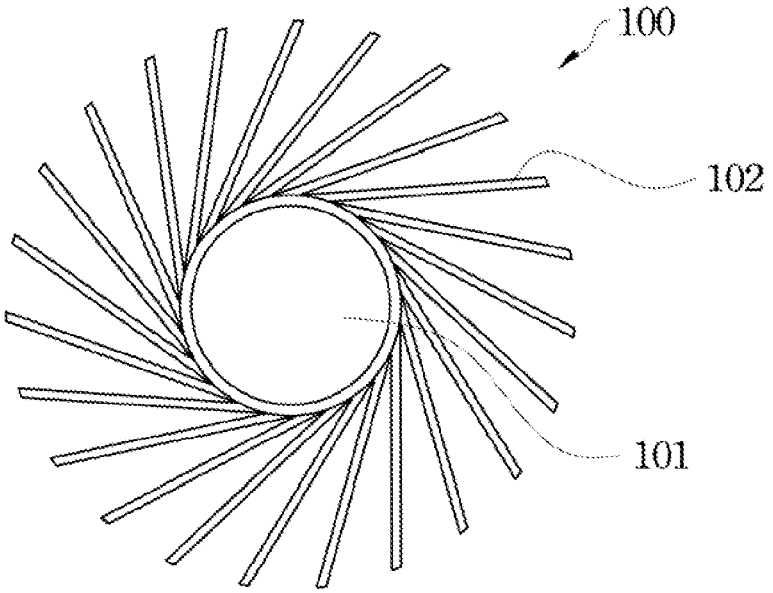
Fig. 1 (Prior Art)
FIG. 1 illustrates a top view of a conventional centrifugal fan.
Figure 2:
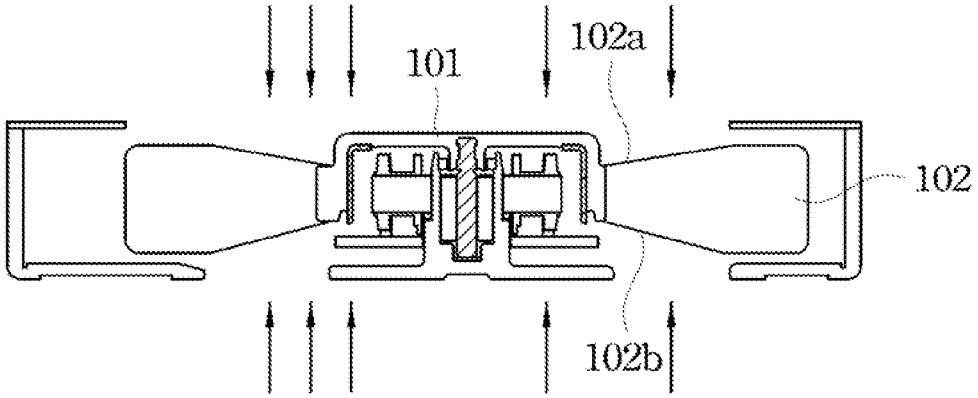
Fig. 2 (Prior Art)
FIG. 2 illustrates a cross-sectional view of a conventional centrifugal fan.

Reference will now be made in detail to the present preferred embodiments of the invention, examples of which are illustrated in the accompanying drawings. Wherever possible, the same reference numbers are used in the drawings and the description to refer to the same or like parts.

As stated above, the present invention provides a high performance centrifugal fan, which is equipped with concave cutouts, so as to improve the centrifugal fan's air intake efficiency.

Figure 3:
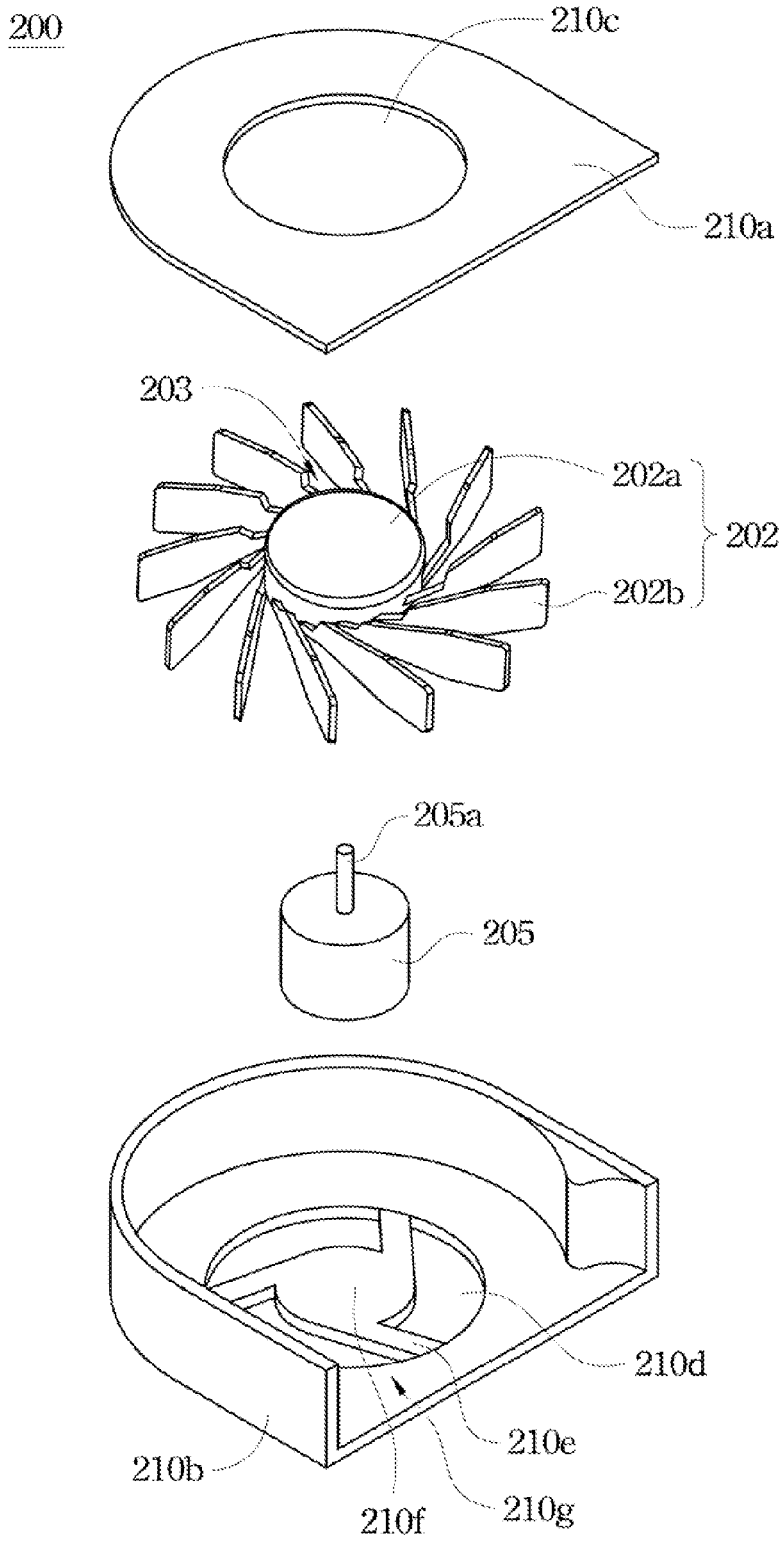
FIG. 3 illustrates an exploded view of a centrifugal fan according to a first embodiment of this invention.

Referring to FIG. 3, which illustrates an exploded view of a centrifugal fan according to a first embodiment of this invention. The centrifugal fan 200 includes an upper case 210*a*, a lower case 210*b*, an impeller 202 and a motor 205. When the upper case 210*a* and the lower case 210*b* are assembled, the impeller 202 and motor 205 are housed within the case (which is the combination of the upper case 210*a* and lower case 210*b*). The motor 205 is secured to a bottom base 210*f* of the lower case 210*b*. A rotation axis 205*a* of the motor 205 is secured to a hub 202*a* of the impeller 202, thereby driving the impeller 202 to rotate. The upper case 210*a* has an air inlet 210*c* while the lower case 210*b* has several air inlets 210*d*, and both the air inlets (210*c*, 210*d*) are disposed along an axial direction of the impeller 202. The air inlets 210*d* are located among several ribs 210*e*, which are interconnected between the bottom base 210*f* and the lower case 210*b*. When the impeller 202 rotates, airflows are introduced through the air inlets (210*c*, 210*d*) and output through the air outlet 210*g*. The air outlet 210*g* is located along a radial direction of the impeller 202. The impeller 202 includes a hub 202*a* and a plurality of blades 202*b*. The blades 202*b* are secured to the hub 202*a* and each blade 202*b* has at least one concave cutout 203 to increase air intake efficiency.

In an alternate embodiment, the air inlet is only designed on the upper case 210*a* or on the lower case 210*b*. That is, the centrifugal fan 200 intakes air through only one side of the impeller 202.

Figure 4:
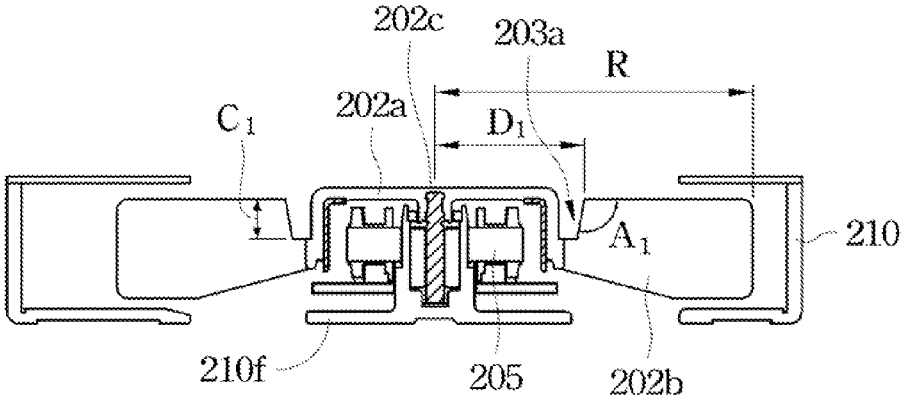
FIG. 4 illustrates a cross-sectional view of a centrifugal fan according to a second embodiment of this invention.

Referring to FIG. 4, which illustrates a cross-sectional view of a centrifugal fan according to a second embodiment of this invention. The centrifugal fan includes a case 210, a motor 205, a hub 202*a* and a plurality of blades 202*b*. The blades 202*b* with their outmost edges define a circle with the center 202*c* (referring also to the blades 202*b* illustrated in FIG. 3) and a radius R. Each blade 202*b* has a concave cutout 203*a*, which is located within a region between the center 202*c* and a distance $D_1$ form the center 202*c*. According to an experiment result, when the distance $D_1$ is about 0.6R, the concave cutout 203*a* can enhance a centrifugal fan's performance effectively. Besides, a depth $C_1$ of the concave cutout 203*a* needs to be greater than 0.5 millimeter, and an angle $A_1$ between an inner edge of the concave cutout 203*a* and an outer edge of the blade 202*b*, is an obtuse angle less than 170 degrees, the centrifugal fan's performance can be enhanced effectively. Otherwise, the concave cutout only reduces a working area, which decreases the centrifugal fan's performance.

Figure 5:
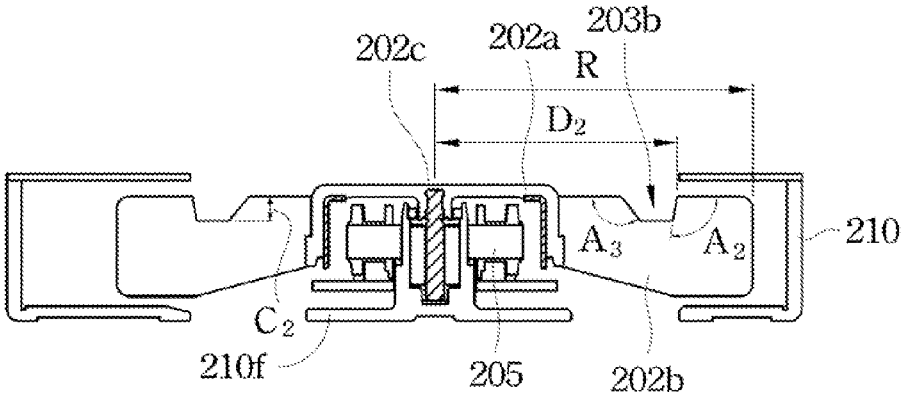
FIG. 5 illustrates a cross-sectional view of a centrifugal fan according to a third embodiment of this invention.

Referring to FIG. 5, it illustrates a cross-sectional view of a centrifugal fan according to a third embodiment of this invention. This embodiment is different from the second embodiment in the concave cutout's locations. In the third embodiment, the concave cutout 203*b* is farther from the hub 202*a* (compared with the concave cutout 203*a*). The concave cutout 203*b* is located within a region between the center 202*c* and a distance $D_2$ from the center 202*c*. According to an experiment result, the distance $D_1$ is about 0.9R, the concave cutout 203*b* can enhance a centrifugal fan's performance effectively. Besides, a depth $C_2$ of the concave cutout 203*b* needs to be greater than 0.5 millimeter, and an angle ($A_2$, $A_3$) between an inner edge of the concave cutout 203*b* and an outer edge of the blade 202*b* is an obtuse angle less than 170 degrees, the centrifugal fan's performance can be enhanced effectively. Otherwise, the concave cutout only reduces a working area, which decreases the centrifugal fan's performance.

Figure 6:
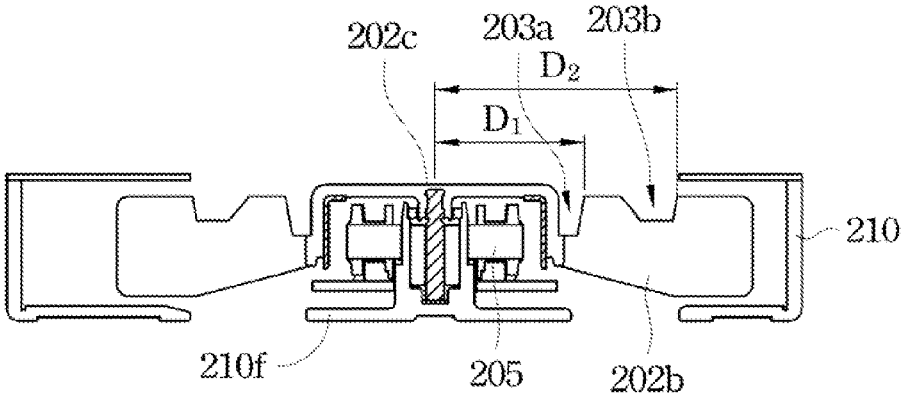
FIG. 6 illustrates a cross-sectional view of a centrifugal fan according to a fourth embodiment of this invention.

Referring to FIG. 6, it illustrates a cross-sectional view of a centrifugal fan according to a fourth embodiment of this invention. Difference between this embodiment and the second and third embodiments is that each blade has two concave cutouts. When each blade 202*b* has the concave cutouts (203*a*, 203*b*), the concave cutout 203*a* is located within a region between the center 202*c* and a distance $D_1$ form the center 202*c*, the concave cutout 203*b* is located within a region between the distance $D_1$ from the center 202*c* and the distance $D_2$ from the center 202*c*, the concave cutouts (203*a*, 203*b*) can enhance the centrifugal fan's performance effectively.

Figure 7:
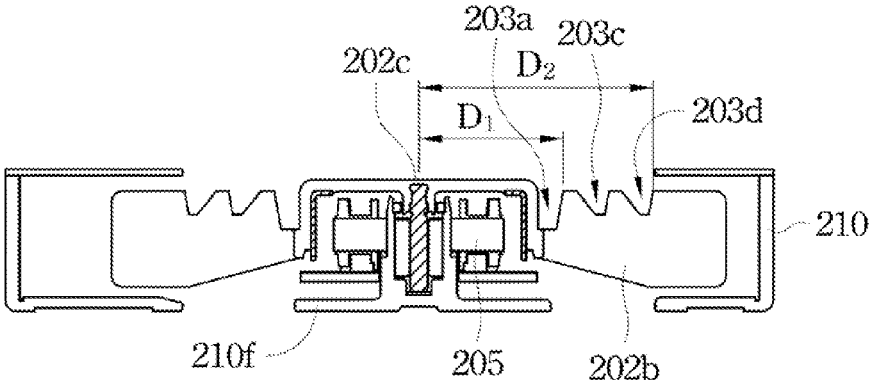
FIG. 7 illustrates a cross-sectional view of a centrifugal fan according to a fifth embodiment of this invention.

Referring to FIG. 7, it illustrates a cross-sectional view of a centrifugal fan according to a fifth embodiment of this invention. Difference between this embodiment and the fourth embodiment is that each blade 202*b* has two concave cutouts located within a region between a distance $D_1$ from the center 202*c* and a distance $D_2$ from the center 202*c*. The concave cutouts (203*c*, 203*d*) are located within a region between a distance $D_1$ from the center 202*c* and a distance $D_2$ from the center 202*c*, and equipped with the characteristics of the above-mentioned cutouts, i.e., the depth greater than 0.5 millimeter and an angle between an inner edge of the concave cutout and an outer edge of the blade is an obtuse angle less than 170 degrees.

Figure 8:
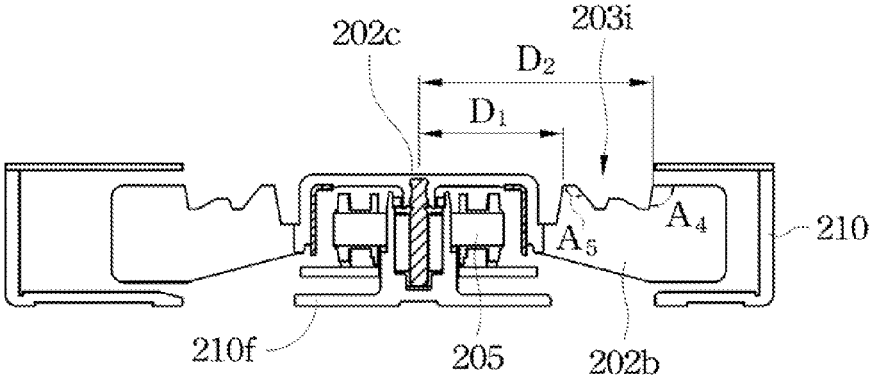
FIG. 8 illustrates a cross-sectional view of a centrifugal fan according to a sixth embodiment of this invention.

Referring to FIG. 8, it illustrates a cross-sectional view of a centrifugal fan according to a sixth embodiment of this invention. Difference between this embodiment and the fifth embodiment is that the concave cutout located within a region between a distance $D_1$ from the center 202*c* and a distance $D_2$ from the center 202*c* has a wider width. The concave cutout 203*i* has a width, which is a slightly narrower than the region between a distance $D_1$ from the center 202*c* and a distance $D_2$ from the center 202*c*. The concave cutout 203*i* needs to be equipped with the characteristics of the above-mentioned cutouts, i.e., the depth greater than 0.5 millimeter and an angle ($A_4$, $A_5$) between an inner edge of the concave cutout and an outer edge of the blade is an obtuse angle less than 170 degrees.

Figure 9:
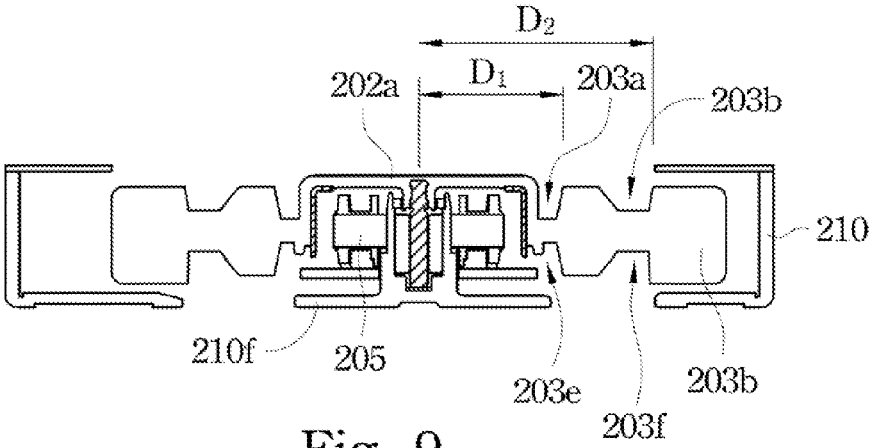
FIG. 9 illustrates a cross-sectional view of a centrifugal fan according to a seventh embodiment of this invention.

Referring to FIG. 9, it illustrates a cross-sectional view of a centrifugal fan according to a seventh embodiment of this invention. Difference between this embodiment and the seventh embodiment is that the concave cutouts are located at two opposite outer edges of each blade 202*b*. In the seventh embodiment, each blade 202*b* has concave cutouts (203*a*, 203*b*) located on upper edges thereof and concave cutouts (203*e*, 203*f*) located on lower edges thereof. The concave cutouts (203*a*, 203*e*) are located within a region between the center 202*c* and a distance $D_1$ from the center 202*c*. The concave cutouts (203*b*, 203*f*) are located within a region between a distance $D_1$ from the center 202*c* and a distance $D_2$ from the center 202*c*. In an alternate embodiment, each blade 202*b* only has the concave cutout 203*a* located on an upper edge thereof and the concave cutout 203*e* located on a lower edge thereof, and the concave cutouts (203*a*, 203*e*) are located within a region between the center 202*c* and a distance $D_1$ from the center 202*c*. In another alternate embodiment, each blade 202*b* only has the concave cutout 203*b* located on an upper edge thereof and the concave cutout 203*f* located on a lower edge thereof, and the concave cutouts (203*b*, 203*f*) are located within a region between a distance $D_1$ from the center 202*c* and a distance $D_2$ from the center 202*c*.

Figure 10:
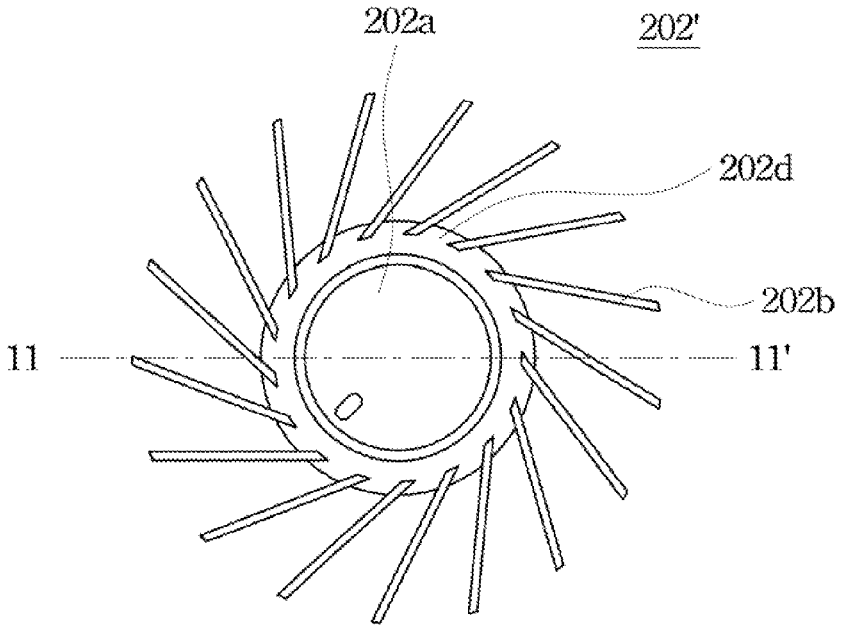
FIG. 10 illustrates a top view of a centrifugal fan according to an eight embodiment of this invention.
Figure 11:
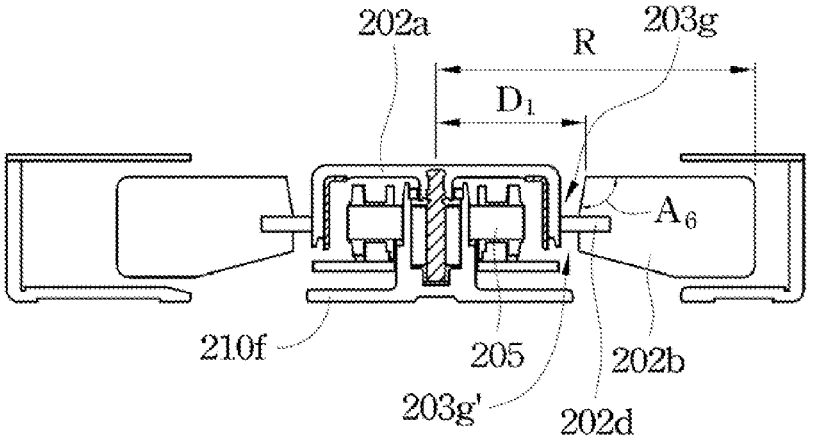
FIG. 11 illustrates a cross-sectional view taken along a cross-sectional line 11-11' in FIG. 10.

Referring to FIG. 10, it illustrates a top view of a centrifugal fan according to an eight embodiment of this invention. FIG. 11 illustrates a cross-sectional view taken along a cross-sectional line 11-11' in FIG. 10. This embodiment is different from the above-discussed embodiments in the impeller's design. In the eighth embodiment, the impeller 202' includes a hub 202*a*, a plurality of blades 202*b* and a connection ring 202*d*. The connection ring 202*d* is located around the hub 202*a*, to which a plurality of blades 202*b* are connected. The connection ring 202*d* can resolve the issue of dense blades around the hub 202*a* so as to enhance the air intake efficiency. At least one concave cutout is formed or defined between each blade 202*b* and the hub 202*a*. The concave cutout can be formed only on an upper side of the connection ring 202*d*, e.g. the concave cutout 203*g*, or formed only on a lower side of the connection ring 202*d*, e.g. the concave cutout 203*g'*. The concave cutouts can also be formed on both upper and lower sides of the connection ring 202*d*. The concave cutouts (203*g*, 203*g'*) are both located within a region between the center 202*c* and a distance $D_1$ from the center 202*c*. The concave cutouts (203*g*, 203*g'*) needs to be equipped with the characteristics of the above-mentioned cutouts, i.e., the depth greater than 0.5 millimeter and an angle (e.g. $A_6$) between an inner edge of the concave cutout and an outer edge of the blade is an obtuse angle less than 170 degrees.

In alternate embodiments, the concave cutouts (203*a*, 203*b*, 203*c*, 203*d*, 203*e*, 203 or 203*i*) as discussed in the foregoing embodiments can also be applied on the impeller 202*b* of the eighth embodiment.

Figure 12:
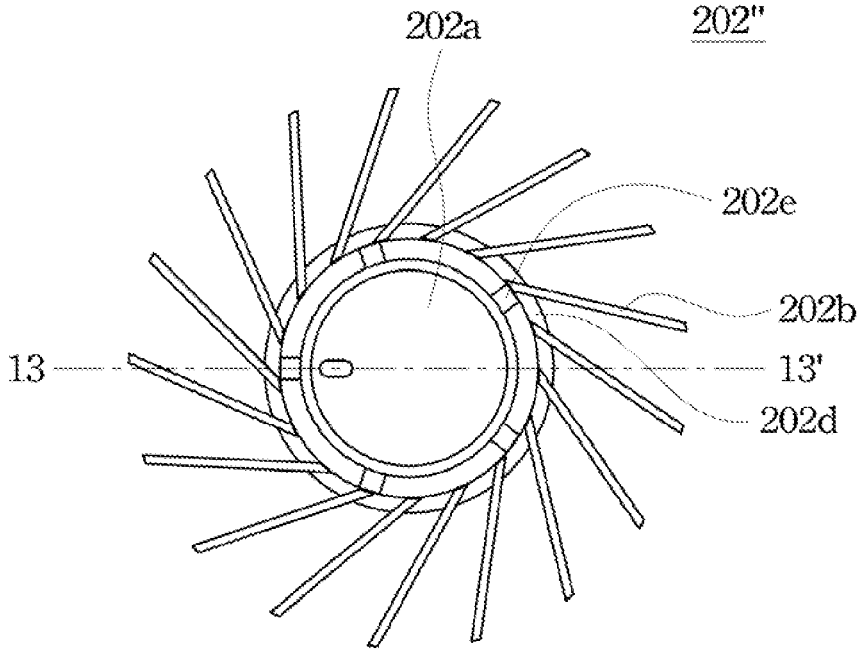
FIG. 12 illustrates a top view of a centrifugal fan according to a ninth embodiment of this invention.
Figure 13:
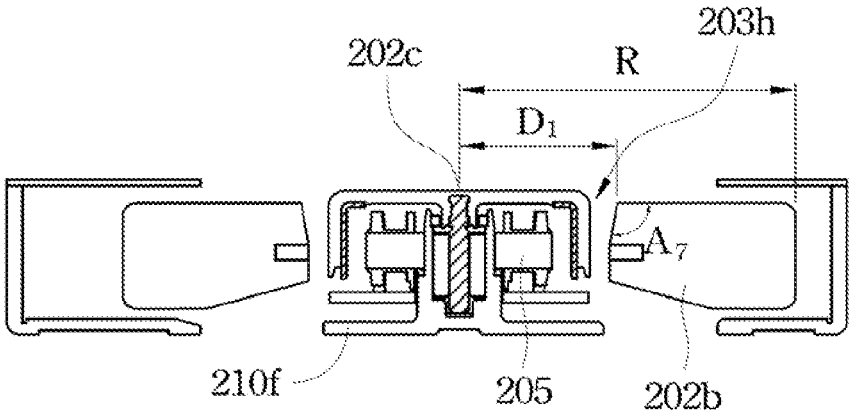
FIG. 13 illustrates a cross-sectional view taken along a cross-sectional line 13-13' in FIG. 12.

Referring to FIG. 12, it illustrates a top view of a centrifugal fan according to a ninth embodiment of this invention. FIG. 13 illustrates a cross-sectional view taken along a cross-sectional line 13-13' in FIG. 12. Difference between this embodiment and the eighth embodiment is that an interconnection design between the connection ring and the hub is different. In the eighth embodiment, an inner edge of the connection ring 202*d* is seamlessly connected with an outer edge of the hub 202*a*. In the ninth embodiment, an inner edge of the connection ring 202*d* is connected with an outer edge of the hub 202*a* with gaps therebetween, and a plurality of ribs 202*e* are interconnected between the connection ring 202*d* and the hub 202*a*. The impeller 202" includes a hub 202*a*, a plurality of blades 202*b*, a rib 202*e* and a connection ring 202*d*. The connection ring 202*d* is located around the hub 202*a*, to which a plurality of blades 202*b* are connected. The connection ring 202*d* can resolve the issue of dense blades around the hub 202*a* so as to enhance the air intake efficiency. At least one concave cutout 203*h* is formed or defined between each blade 202*b* and the hub 202*a*. The concave cutout 203*h* is located within a region between the center 202*c* and a distance $D_1$ from the center 202*c*. The concave cutout 203*h* needs to be equipped with the characteristics of the above-mentioned cutouts, i.e., the depth greater than 0.5 millimeter and an angle (e.g. $A_7$) between an inner edge of the concave cutout and an outer edge of the blade is an obtuse angle less than 170 degrees.

In alternate embodiments, the concave cutouts (203*a*, 203*b*, 203*c*, 203*d*, 203*e*, 203 or 203*i*) as discussed in the foregoing embodiments can also be applied on the impeller 202*b* of the ninth embodiment.

According to above-discussed embodiments, the "concave cutout" design on the impeller and centrifugal fan thereof can further enhance its performance, but does not decrease its working areas too much, which inversely impact the centrifugal fan's performance.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A centrifugal fan comprising:
a case having an air inlet;
a hub having a center and disposed within the case; and
a plurality of blades connected to the hub and disposed within the case, all the blades having respective outmost edges, which collectively define a circle with the center and a radius R, each blade has at least one first concave cutout, which comprises:
a depth of greater than 0.5 millimeters; and
an obtuse angle of less than 170 degrees, the obtuse angle is an angle between an inner edge of the first concave cutout and an outer edge of the blade,
each blade further comprises at least two second concave cutouts disposed within a region between 0.6R from the center and 0.9R from the center, wherein the two second concave cutouts are disposed at opposite outer edges of each blade, wherein the first and one of the second concave cutouts are aligned with and exposed by the air inlet of the case, wherein each blade has an outmost edge that is disposed within a region between from 0.9R from the center and 1R from the center, and the outmost edge is not exposed by the air inlet of the case and is in an area that is not occupied by the first and second concave cutouts.

2. The centrifugal fan of claim 1, wherein the first concave cutout of each blade is disposed within a region between the center and 0.6R from the center.

3. The centrifugal fan of claim 1, wherein a number of the first concave cutout is at least two, the two first concave cutouts of each blade are disposed within a region between the center and 0.6R from the center, and the two first concave cutouts are disposed at two opposite outer edges of each blade.

4. A centrifugal fan comprising:
a case having an air inlet;
a hub having a center and disposed within the case;
a connection ring disposed around the hub; and
a plurality of blades connected to the connection ring and disposed within the case, all the blades having respective outmost edges, which collectively define a circle with the center and a radius R, at least one first concave cutout is formed between each blade and the hub, each blade further comprises at least two second concave cutouts, which are disposed within a region between 0.6R from the center and 0.9R from the center, wherein the two second concave cutouts are disposed at opposite outer edges of each blade, wherein the first and one of the second concave cutouts are aligned with and exposed by the air inlet of the case, each blade has an outmost edge that is disposed within a region between 0.9R from the center and 1R from the center, and the outmost edge is not exposed by the air inlet of the case and is in an area that is not occupied by the first and second concave cutouts, wherein the first concave cutout comprises:
a depth of greater than 0.5 millimeters; and
an obtuse angle of less than 170 degrees, wherein the obtuse angle is an angle between an inner edge of the first concave cutout and an outer edge of the blade.

5. The centrifugal fan of claim 4, wherein an inner edge of the connection ring is seamlessly connected with an outer edge of the hub.

6. The centrifugal fan of claim 5, wherein the first concave cutout is disposed within a region between the center and 0.6R from the center.

7. The centrifugal fan of claim 6, wherein a number of the first concave cutout is at least two, and the two first concave cutouts are disposed at two opposite outer edges of the blade.

8. The centrifugal fan of claim 4, wherein an inner edge of the connection ring is connected with an outer edge of the hub with gaps therebetween.

9. The centrifugal fan of claim 8, wherein the first concave cutout is disposed within a region between the center and 0.6R from the center.

10. A centrifugal fan comprising:
an impeller comprising:
a hub having a center; and
a plurality of blades connected to the hub, all the blades having respective outmost edges, which collectively define a circle with the center and a radius R, each blade has at least one first concave cutout, which comprises:
a depth of greater than 0.5 millimeters; and
an obtuse angle of less than 170 degrees, wherein the obtuse angle is an angle between an inner edge of the first concave cutout and an outer edge of the blade;
each blade further comprises at least two second concave cutouts, which are disposed within a region between 0.6R from the center and 0.9R from the center, wherein the two second concave cutouts are disposed at opposite outer edges of each blade,
a motor secured to the hub and drive the impeller to rotate; and
a case, housing the impeller and the motor and having at least one air inlet disposed along an axial direction of the impeller and at least one air outlet disposed along a radial direction of the impeller, wherein the first and one of the second concave cutouts are aligned with and exposed by the air inlet of the case, each blade has an outmost edge that is disposed within a region between 0.9R from the center and 1R from the center, and the outmost edge is not exposed by the air inlet of the case and is in an area that is not occupied by the first and second concave cutouts.

11. The centrifugal fan of claim 10, wherein the first concave cutout of each blade is disposed within a region between the center and 0.6R from the center.

12. A centrifugal fan comprising:

an impeller comprising:

a hub having a center;

a connection ring disposed around the hub; and a plurality of blades connected to the hub, all the blades having respective outmost edges, which collectively define a circle with the center and a radius R, each blade has at least one first concave cutout, which comprises:

a depth of greater than 0.5 millimeters; and an obtuse angle of less than 170 degrees, wherein the obtuse angle is an angle between an inner edge of the first concave cutout and an outer edge of the blade;

each blade further comprises at least two second concave cutouts, which are disposed within a region between 0.6R from the center and 0.9R from the center, wherein the two second concave cutouts are disposed at opposite outer edges of each blade, a motor secured to the hub and drive the impeller to rotate; and a case, housing the impeller and the motor and having at least one air inlet disposed along an axial direction of the impeller and at least one air outlet disposed along a radial direction of the impeller, wherein the first and one of the second concave cutouts are aligned with and exposed by the air inlet of the case, each blade has an outmost edge that is disposed within a region between 0.9R from the center and 1R from the center, and the outmost edge is not exposed by the air inlet of the case and is in an area that is not occupied by the first and second concave cutouts.

13. The centrifugal fan of claim 12, wherein an inner edge of the connection ring is seamlessly connected with an outer edge of the hub, and the first concave cutout is disposed within a region between the center and 0.6R from the center.

14. The centrifugal fan of claim 12, wherein an inner edge the connection ring is seamlessly connected with an outer edge of the hub.

15. The centrifugal fan of claim 12, wherein an inner edge of the connection ring is connected with an outer edge of the hub with gaps therebetween, and the first concave cutout is disposed within a region between the center and 0.6R from the center.

16. The centrifugal fan of claim 12, wherein an inner edge of the connection ring is connected with an outer edge of the hub with gaps therebetween.

* * * * *